US010914117B2

(12) United States Patent
Rejc

(10) Patent No.: US 10,914,117 B2
(45) Date of Patent: Feb. 9, 2021

(54) VERTICALLY MOVABLE GATE WITH A GATE PANEL

(71) Applicant: Gabrijel Rejc, Landshut (DE)

(72) Inventor: Gabrijel Rejc, Landshut (DE)

( * ) Notice: Subject to any disclaimer, the term of this patent is extended or adjusted under 35 U.S.C. 154(b) by 393 days.

(21) Appl. No.: 15/739,582

(22) PCT Filed: Jun. 26, 2017

(86) PCT No.: PCT/EP2017/065622
§ 371 (c)(1),
(2) Date: Dec. 22, 2017

(87) PCT Pub. No.: WO2018/001923
PCT Pub. Date: Jan. 4, 2018

(65) Prior Publication Data

US 2018/0258689 A1 Sep. 13, 2018

(30) Foreign Application Priority Data

Jun. 28, 2016 (EP) ..... 16176549

(51) Int. Cl.
*E06B 9/15* (2006.01)
*E05D 15/24* (2006.01)
(Continued)

(52) U.S. Cl.
CPC ..... *E06B 9/15* (2013.01); *E05D 15/242* (2013.01); *E05F 15/684* (2015.01); *E06B 9/581* (2013.01);
(Continued)

(58) Field of Classification Search
CPC ... E06B 9/15; E06B 9/581; E06B 9/56; E06B 9/58; E06B 2009/1533; E06B 2009/155;
(Continued)

(56) References Cited

U.S. PATENT DOCUMENTS 1,416,071 A 5/1922 Smurr
1,942,320 A 1/1934 Young
(Continued)

FOREIGN PATENT DOCUMENTS

CN 2122972 U 11/1992
CN 2157356 Y 2/1994
(Continued)

OTHER PUBLICATIONS

International Search Report for application PCT/EP2017/065622, dated Sep. 26, 2017.
(Continued)

*Primary Examiner* — Johnnie A. Shablack
(74) *Attorney, Agent, or Firm* — Hahn Loeser & Parks LLP; Bret A. Hrivnak

(57) ABSTRACT

The invention relates to a vertically movable gate with a gate panel comprising several gate panel segments, where two adjacent gate panel segments are each hingedly connected to one another by way of at least one hinge, and with a motorized drive which transmits a force for lifting and lowering the gate panel via at least one drive means to the gate panel, and a connection means for connecting the drive means to the gate panel. Gates of the type mentioned at the outset are improved according to the invention such that, though such a gate can be moved easily between an open and a closed position largely independent of the forces arising, it nevertheless provides a compact and simultaneously stable and fail-safe design in that several gate panel segments are each individually connected to the drive means.

24 Claims, 10 Drawing Sheets

Figure 1:
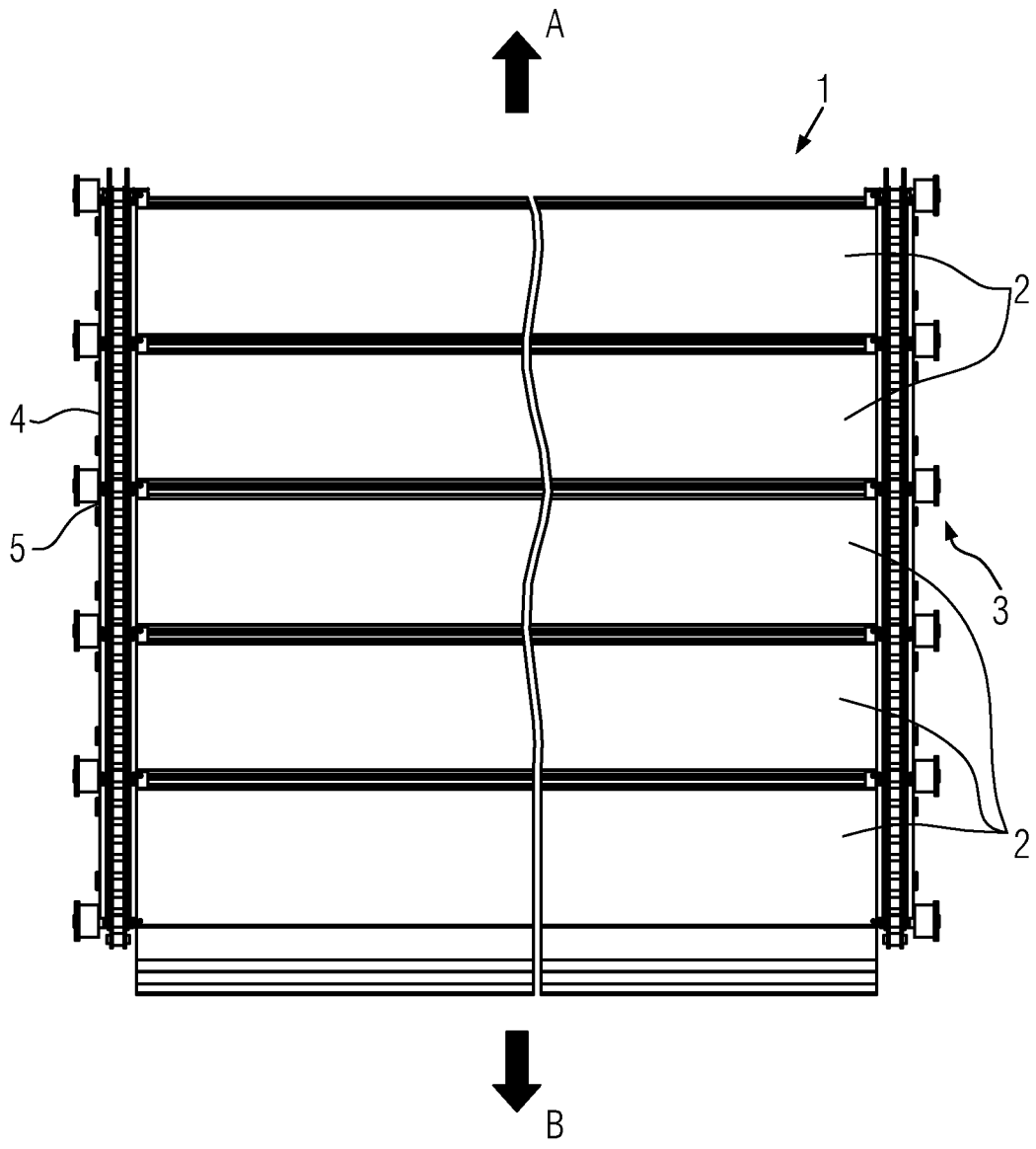

(51) Int. Cl.

| | |
|---|---|
| ***E06B 9/58*** | (2006.01) |
| ***E06B 9/68*** | (2006.01) |
| ***E05F 15/684*** | (2015.01) |
| *E06B 9/90* | (2006.01) |
| *E06B 9/62* | (2006.01) |

(52) U.S. Cl.

CPC ..... *E06B 9/68* (2013.01); *E05Y 2900/106* (2013.01); *E06B 9/582* (2013.01); *E06B 9/62* (2013.01); *E06B 9/90* (2013.01); *E06B 2009/1505* (2013.01); *E06B 2009/1555* (2013.01); *E06B 2009/1566* (2013.01); *E06B 2009/1583* (2013.01); *E06B 2009/588* (2013.01); *E06B 2009/6836* (2013.01); *E06B 2009/6845* (2013.01); *E06B 2009/6872* (2013.01)

(58) Field of Classification Search

CPC ..... E06B 2009/1555; E06B 2009/1566; E06B 2009/1577; E06B 2009/1588; E06B 2009/1583; E06B 2009/1505; E06B 2009/583; E06B 2009/588; E05F 15/684; E05F 15/686; E05F 15/681; E05D 15/24; E05D 15/242

See application file for complete search history.

(56) References Cited

U.S. PATENT DOCUMENTS 2,055,511 A 9/1936 Twiss
2,122,972 A 7/1938 Arbib
2,157,356 A 5/1939 Sibley
2,844,843 A 7/1958 Logan
3,007,194 A 11/1961 Griswold
4,119,133 A * 10/1978 Wolf ..... E05D 15/246 160/201
4,126,173 A * 11/1978 Theuerkauff ..... E06B 9/08 160/229.1
4,811,777 A * 3/1989 Chretien ..... E06B 9/13 160/189
4,986,331 A * 1/1991 Henkenjohann ..... E06B 9/11 160/201
5,065,806 A * 11/1991 Kondoh ..... E06B 9/0638 160/36
5,188,161 A * 2/1993 Erber ..... E06B 7/086 160/133
5,377,738 A * 1/1995 Cooper ..... E06B 9/15 160/133
5,394,924 A * 3/1995 Rejc ..... E05D 15/24 160/201
5,484,007 A * 1/1996 Rejc ..... E06B 3/485 160/133
5,488,982 A 2/1996 Rejc
5,535,805 A * 7/1996 Kellogg ..... E05D 15/165 16/87 R
5,551,535 A 9/1996 Krolo et al.
5,566,737 A * 10/1996 Erber ..... E06B 9/34 160/133
5,711,113 A 1/1998 Nygaard
5,829,504 A * 11/1998 Ekstrand ..... E05D 15/165 160/201
5,831,403 A 11/1998 Kanki et al.
6,041,844 A * 3/2000 Kellogg ..... E05D 15/165 16/87 R
6,042,158 A 3/2000 Horn
6,092,338 A 7/2000 Crowner et al.
6,123,139 A * 9/2000 Kalempa ..... E05D 15/165 160/133
6,137,251 A 10/2000 Huang et al.
6,172,475 B1 1/2001 Fitzgibbon et al.
6,289,966 B1 9/2001 Hoermann
6,330,903 B1 12/2001 Weinreich
6,427,749 B1 * 8/2002 Swink ..... B60J 5/08 160/133
6,672,362 B1 * 1/2004 Mullet ..... E05D 15/165 16/225
6,920,718 B2 7/2005 Hom et al.
6,928,696 B2 * 8/2005 Wartman ..... E05D 15/24 16/106
7,064,505 B2 6/2006 Sato
7,208,897 B2 4/2007 Hotto et al.
7,212,897 B2 5/2007 Suzuki et al.
7,723,936 B2 5/2010 Schaefer
7,798,198 B2 * 9/2010 Rejc ..... E06B 9/08 160/133
7,913,739 B2 * 3/2011 Rejc ..... E06B 9/08 160/133
7,941,972 B2 5/2011 Kamiya et al.
8,011,414 B2 * 9/2011 Levy ..... E06B 9/34 160/116
8,026,809 B2 9/2011 Schaefer et al.
8,169,169 B2 5/2012 Hass et al.
8,899,297 B2 12/2014 Mazej et al.
8,991,275 B2 3/2015 Ishikawa
9,243,685 B2 * 1/2016 Hawkins ..... E05F 15/684
9,267,326 B2 * 2/2016 Gomaa ..... E06B 9/70
9,416,579 B2 8/2016 Rejc
9,487,986 B2 * 11/2016 Okachi ..... E06B 9/54
9,624,708 B2 * 4/2017 Balay ..... E05D 15/165
9,803,420 B2 * 10/2017 Ronchetti ..... E06B 9/15
9,915,094 B2 * 3/2018 Frede ..... E06B 9/17
10,012,015 B2 7/2018 Rejc
10,053,901 B2 * 8/2018 Schweiss ..... E05D 15/264
10,190,362 B2 * 1/2019 Fischer ..... E06B 9/0638
10,253,557 B2 * 4/2019 Frede ..... E06B 9/15
10,344,527 B2 * 7/2019 Balbach ..... E06B 9/58
2003/0047291 A1 3/2003 Klein
2004/0173326 A1 * 9/2004 Dittmer ..... E05D 15/242 160/201
2004/0183677 A1 9/2004 Fitzgibbon
2005/0126720 A1 * 6/2005 Rekret ..... E05F 15/67 160/201
2006/0162876 A1 7/2006 Kwak
2007/0062650 A1 * 3/2007 Rejc ..... E06B 9/08 160/133
2008/0210386 A1 * 9/2008 Neuhaus ..... E06B 9/08 160/133
2011/0146920 A1 * 6/2011 Mazej ..... E06B 9/08 160/311
2011/0271595 A1 11/2011 Eggeling et al.
2014/0117757 A1 5/2014 Tsui et al.
2014/0332172 A1 11/2014 Hsieh
2015/0300084 A1 * 10/2015 Schonerwald ..... E06B 9/15 160/133
2015/0322703 A1 11/2015 Matsuo
2015/0368962 A1 * 12/2015 Motosko ..... E06B 9/581 160/107
2016/0348429 A1 * 12/2016 Frede ..... E06B 9/88
2017/0009524 A1 * 1/2017 Dwarka ..... E06B 9/24
2018/0073296 A1 * 3/2018 Chen ..... E06B 9/52
2018/0258689 A1 9/2018 Rejc
2018/0313140 A1 11/2018 Rejc
2019/0390511 A1 * 12/2019 Lambridis ..... E06B 9/70

FOREIGN PATENT DOCUMENTS

CN 103775561 A 5/2014
DE 7426752 U 5/1975
DE 2542801 A1 4/1976
DE 2935490 A1 3/1981
DE 4015214 A1 11/1991
DE 19831806 A1 1/1999
DE 19952038 10/2000
DE 10011789 A1 9/2001
DE 20112771 U1 12/2001
DE 10232577 A1 2/2004
DE 60309310 T2 5/2007
DE 102006033708 A1 8/2007
DE 102009044492 A1 5/2011
DE 102012101415 B3 3/2013

(56) References Cited

FOREIGN PATENT DOCUMENTS

| | | | |
|---|---|---|---|
| DE | 202012012514 | U1 | 4/2013 |
| EP | 0056650 | A2 | 1/1982 |
| EP | 0128391 | A | 7/1985 |
| EP | 808985 | A2 | 11/1997 |
| EP | 0945575 | A2 | 9/1999 |
| EP | 1816307 | A1 | 8/2007 |
| EP | 1882802 | A2 | 1/2008 |
| EP | 2148040 | A1 | 1/2010 |
| EP | 2887535 | A1 | 6/2015 |
| GB | 570469 | A | 7/1945 |
| GB | 746253 | A | 3/1956 |
| GB | 1013644 | | 12/1965 |
| GB | 2141171 | A | 12/1984 |
| JP | H07-006491 | U | 1/1995 |
| JP | H07-023191 | U | 4/1995 |
| JP | 2007177430 | A | 7/2007 |
| JP | 2008261182 | A | 10/2008 |
| JP | 2008291546 | A | 12/2008 |
| JP | 2012500347 | A | 1/2012 |
| WO | 9839542 | A1 | 9/1998 |
| WO | 2009112562 | A1 | 9/2009 |
| WO | 2015144729 | A1 | 10/2015 |

OTHER PUBLICATIONS

European Search Report for application EP16176549.0, dated Nov. 9, 2016.

EP16176550.8—European Search Report dated Oct. 18, 2016, 4 pages.

PCT/EP2017/065623—International Search Report dated Sep. 28, 2017, 6 pages.

PCT/EP2017/079330—International Search Report and Written Opinion dated Mar. 1, 2018, 11 pages.

PCT/EP2017/083109—International Search Report and Written Opinion dated Apr. 9, 2018, 13 pages.

* cited by examiner

VERTICALLY MOVABLE GATE WITH A GATE PANEL

The invention relates to a vertically movable gate with a gate panel, which comprises several gate panel segments, according to the preamble of claim 1.

Lifting gates of this type are used for opening and closing passages. They are frequently used as garage doors or, for example, as gates for supply ramps. However, they are also used as room dividers in warehouses. Since these gates are often very heavy, they are usually driven primarily by a motor.

Such a motor drive usually comprises at least one motor which is connected to the gate via drive means, such as drive belts or drive chains. Depending on the rotational speed and the torque of the motor, so-called high-speed gates used in the industry can be realized. In high-speed gates, gate panel speeds of up to 4 m/s can be reached, whereas the gate panels of conventional industrial lifting gates are moved at speeds of typically 0.2-0.3 m/s.

Gates of the type mentioned above are known, for example, from DE 10 2012 101 415 A1. This publication discloses a gate with a motor drive, the drive means of which has a drive chain on the load span side and a drive belt on the return span side. A driving member is arranged between the belt and the chain and is used to connect to the gate panel which is composed of several segments. While the individual gate panel segments are connected to one another by hinges, the lowermost gate panel segment is connected to the drive chain via the drive member.

DE 10 2009 044 492 A1 also discloses a vertically movable gate with a gate panel composed of several segments. The gate is moved by a motor drive, where a toothed belt serves as a force-transmitting drive element. The individual gate panel segments are connected to each other by hinges, where the toothed belt engages at a base side end section of the gate panel, i.e. at the lower end element or at the lower gate panel segment.

The lifting gates known from prior art favor connection of the gate panel to the drive means in a simple manner. The individual gate panel segments are connected to each other by hinges. The lowermost gate panel segment is connected to the drive means. This establishes a simple connection to the motor drive. The loads acting upon the gate panel in the case of a motorized drive also largely correspond to the loads which occur when the gate is lifted manually. Age-related changes in the length of the drive means beyond that do not substantially affect the synchronous run of the gate panel or the individual gate panel segments among each other. In addition to the static weight of the gate panel, the connection means also have to absorb the dynamic forces occurring during operation, which can be very high, in particular with high-speed gates. The connection means, which connect the lowermost gate panel segment to the drive means, must therefore be sized according to the dimensions and the weight of the gate panel.

Larger drives or larger connection means, however, at the same time also require a larger installation space, which usually results in the gate frames being wider and in turn in a limitation of the passage height or passage width of the gate.

The invention is therefore based on the object to improve a gate of the type initially mentioned in such a way that this gate is movable largely independent of the forces occurring between an open position and a closed position, while providing a compact and at the same time stable and reliable design.

This object according to the invention is satisfied by a gate having the features of the characterizing part of claim 1.

Connecting several individual gate panel segments to the drive means leads to the positive effect that both the static and the dynamic forces are introduced into the gate panel or into the drive means, respectively, at several points. The forces arising are distributed onto several connecting points between the drive means, the connection means and the gate panel segment.

When the gate is opened, the drive means is predominantly subjected to tensile load. Compressive loads between the gate panel segments of gate panel segments known from prior art can thereby be substantially reduced or even prevented.

Even large or heavy gates can thus be moved easily between an open and a closed position, despite the associated forces arising. The connection according to the invention of several individual gate panel segments to the drive means also has the advantage that the connection means for connecting the drive means to the gate panel can have correspondingly smaller dimensions due to the distribution of the total force onto several connecting points. In addition, also the drive means can be reduced in size, which further promotes a compact design of the gate.

In one possible embodiment of the invention, each gate panel segment can be connected to the drive means. The forces arising are thus distributed to all connecting points between the drive means and the gate panel and thereby to the entire gate panel or to the entire drive means, respectively.

The drive means can be, for example, a finite drive means, preferably a chain, and in particular a hollow pin chain.

With a finite drive means, its return on the side of the return span and a deflection roller at the lower end of the gate can be dispensed with, whereby installation space can be saved. A chain serving as a drive means represents a particularly advantageous embodiment of a drive means for such gates due to its limited change in length during operation. In particular, a hollow pin chain provides for a reduction in weight of the drive means while providing a high load-bearing capacity.

It is conceivable that the connection means extends through a part of the drive means. This results in good force transmission as directly as possible between the drive means and the gate panel. In addition, a compact design of a connecting point provided between the drive means and the gate panel can be realized in this manner.

A connection means can possibly be arranged in the joint region of a hinge, and can be, in particular, a hinge pin connecting the two hinge parts ("Scharniergewerbe") of a hinge. Such a configuration of the connection means provides for a particularly advantageous and space-saving arrangement. In particular, if the connection means is designed as a hinge pin, an additional separate hinge pin can be dispensed with, which in turn contributes to a compact design of the gate.

Furthermore, it is proposed that a hinge part ("Scharniergewerbe") of a hinge has at its one end a fixed bearing and at its opposite end a floating bearing. This realizes a bearing location with a rotational as well as a bearing location with a rotational and translational degree of freedom, so that a destruction-free length change between two hinge parts ("Scharniergewerbe") is made possible in a particularly advantageous manner.

It is also conceivable that the individual hinge parts ("Scharniergewerbe") can be connected to one another and form a hinge chain. With such a hinge chain, the individual gate panel segments can be easily combined into a common stable gate panel, where the individual gate panel segments can be configured as having a lightweight design.

The hinge parts ("Scharniergewerbe") of a hinge can possibly be formed combined to the drive means. A combination of the drive means and the hinge parts ("Scharniergewerbe") can combine the individual functions of these two parts and saves installation space as compared to a separate configuration of the two parts. This in turn promotes a compact design of the gate. The drive means can be arranged integrated into the hinge parts ("Scharniergewerbe") of a hinge. It is conceivable for the drive means to be arranged, for example, in a recess, in a cavity or in the interior of the hinge. An integrated arrangement of the drive means in the hinge parts ("Scharniergewerbe") provides for a narrow and compact configuration of the drive and thus for a compact design of the gate.

It is additionally conceivable that the parts ("Scharniergewerbe") of a hinge comprise a recess for receiving the drive means, where the recesses of the individual parts ("Scharniergewerbe") are arranged in alignment with each other. The recesses provided in the individual parts ("Scharniergewerbe") can then provide a kind of channel for the drive element, where this channel is able to be used for receiving and guiding as well as protecting the drive means against external influences, such as, for example, external mechanical force.

According to one embodiment of the invention, a damper can be provided between the drive means and at least one surface of a hinge part ("Scharniergewerbe") and can be suitable for damping a relative motion between the drive means and the hinge part ("Scharniergewerbe"). Such a damper can limit the movability of the drive means relative to the hinge part ("Scharniergewerbe") and thereby, firstly, reduce the formation of noise and, secondly, reduce the wear caused by a collision of the drive means with the hinge part ("Scharniergewerbe") when the gate panel is opened and closed.

The drive means can be inserted into the recess of the hinge parts ("Scharniergewerbe"), where the connection means connects the drive means to the hinge parts ("Scharniergewerbe"). A particularly space-saving arrangement can be realized if the drive means is inserted into the recess, where the connection means connecting the gate panel to the drive means can also simultaneously be used for connecting the hinge parts ("Scharniergewerbe").

It is conceivable that the connection means comprises a guide roller having a shoulder for horizontally guiding the gate panel segments during a vertical motion of the gate panel, and in particular, that the connection means is an axle that bears this guide roller. In situations, in which external forces act upon the gate panel, such as wind force, this can result in individual gate panel segments being pressed out of the gate frame in an approximately horizontal direction. A guide roller comprising a shoulder can counteract this. Such a roller can also guide the gate panel in the frame during a vertical motion. In order to save installation space in spite of the use of such a guide roller, the connection means can be designed as an axle that bears this guide roller.

In particular, a sliding element can be arranged between at least one surface of a gate frame profile and at least one hinge part ("Scharniergewerbe") and which sliding element can be supported, in particular, at the connection means. The sliding element guides the gate panel horizontally during its opening and closing motion. Possible friction-induced wear may occur to a large degree at the sliding disks and to a lesser degree at other components of the device.

In one embodiment, the sliding element can be provided between the hinge part ("Scharniergewerbe") and a guide roller. This allows the horizontal position of the sliding element to be determined and the guide roller to be supported against the hinge part ("Scharniergewerbe"). It is also conceivable that the drive means and the hinges are arranged between a guide roller and a gate panel segment. This results in a particularly space-saving arrangement of the individual components, which in turn contributes to a compact design of the gate.

Furthermore, it would be possible that a hinge part ("Scharniergewerbe") comprises at least one lateral guide element which is suitable to guide the gate panel segment connected to this hinge part ("Scharniergewerbe") in the horizontal direction during a vertical motion of the gate panel. Correct guidance of the entire gate panel during a vertical motion can thereby be ensured, which contributes to good operability of the gate.

In one possible embodiment of the invention, the respective hinge part ("Scharniergewerbe") can be arranged on an end side on the face side of the respective gate panel segment facing the gate frame. In addition, the respective hinge part ("Scharniergewerbe") can extend approximately over the entire height of the respective gate panel segment. A particularly simple embodiment of the individual hinge parts ("Scharniergewerbe") can be realized in this manner, for example, as a simple injection-molded member. The extension of the hinge part ("Scharniergewerbe") over approximately the entire height of the gate panel segment offers the advantage that a large connecting surface is provided between the gate panel segment and the hinge part ("Scharniergewerbe"), so that a good connection can be realized.

Optionally, the respective hinge part ("Scharniergewerbe") can be arranged in a cavity of the respective gate panel segment and can be connected substantially to the respective gate panel segment within this cavity, where the respective hinge part ("Scharniergewerbe") and the respective gate panel segment are connected to one another, in particular, by adhesive bonding. This arrangement of the hinge part ("Scharniergewerbe") in a cavity of the gate panel segment offers the advantage that the hinge part ("Scharniergewerbe") is at least in part arranged within the gate panel segment, which leads to a compact configuration of the gate. In addition, a sufficiently large area is available for adhesively bonding the two parts.

Advantageously, at least one hinge part ("Scharniergewerbe") can be connected to a gate panel segment by way of a screw connection, where preferably the gate panel segment can comprise at least one bore with a thread and the hinge part ("Scharniergewerbe") at least one through bore through which a screw can extend. The screw connection is a favorable and reliable type of connection, which also makes it possible to dismantle the gate panel segments from the hinge parts ("Scharniergewerbe") and to replace them, depending on the field of application, whereby the gate panel can be adapted with less effort to different tasks.

It is proposed that the connection means is connected to the respective gate panel segment in the upper half of a gate panel segment, and in particular, in the region of an upper edge of the gate panel segment. Since the connection means is located in the upper half, i.e. above the pivot axis of the gate panel segment, a suspended support structure is implemented, where a gate panel segment is suspended from the connection means following gravity. The individual gate panel segments are thus pulled by the drive means during a vertical motion of the gate panel, which leads to tautening the individual gate panel segments among each other, thereby improving the stability as well as the operability and the durability of the gate.

In one advantageous variant, a drive element, preferably a sprocket, can engage with the drive means and be provided above a passage height of the gate, preferably in a gate lintel. Due to the arrangement of a drive element above the passage height and, in particular, in the gate lintel, the frame width can be kept small. The passage height is then also kept as large as possible, since the drive element is accommodated in the frame above the passage height.

A guide can possibly be provided which holds the elongate drive means in the region of the drive element in engagement with the elongate drive means. This assists in driving the gate panel in a smooth and reliable manner.

In one development of the invention, the guide can have at least one counter bearing which forces the elongate drive means in the direction of the drive element and is, in particular, suitable for engaging with a hinge part ("Scharniergewerbe"). As a result, the engagement between the drive means and the drive element can be further improved. When the hinge part ("Scharniergewerbe") is coupled to the drive means, the counter bearing can act favorably on the drive means when the hinge part ("Scharniergewerbe") is engaged.

According to one embodiment, the guide can comprise at least one retaining roller which is, in particular, suitable for rolling engagement with a hinge part ("Scharniergewerbe"). Any friction possibly arising between the guide and the movable components of the gate can be reduced by the retaining roller, which leads to less energy being required for movement of the gate panel and to less wear.

Figure 2:
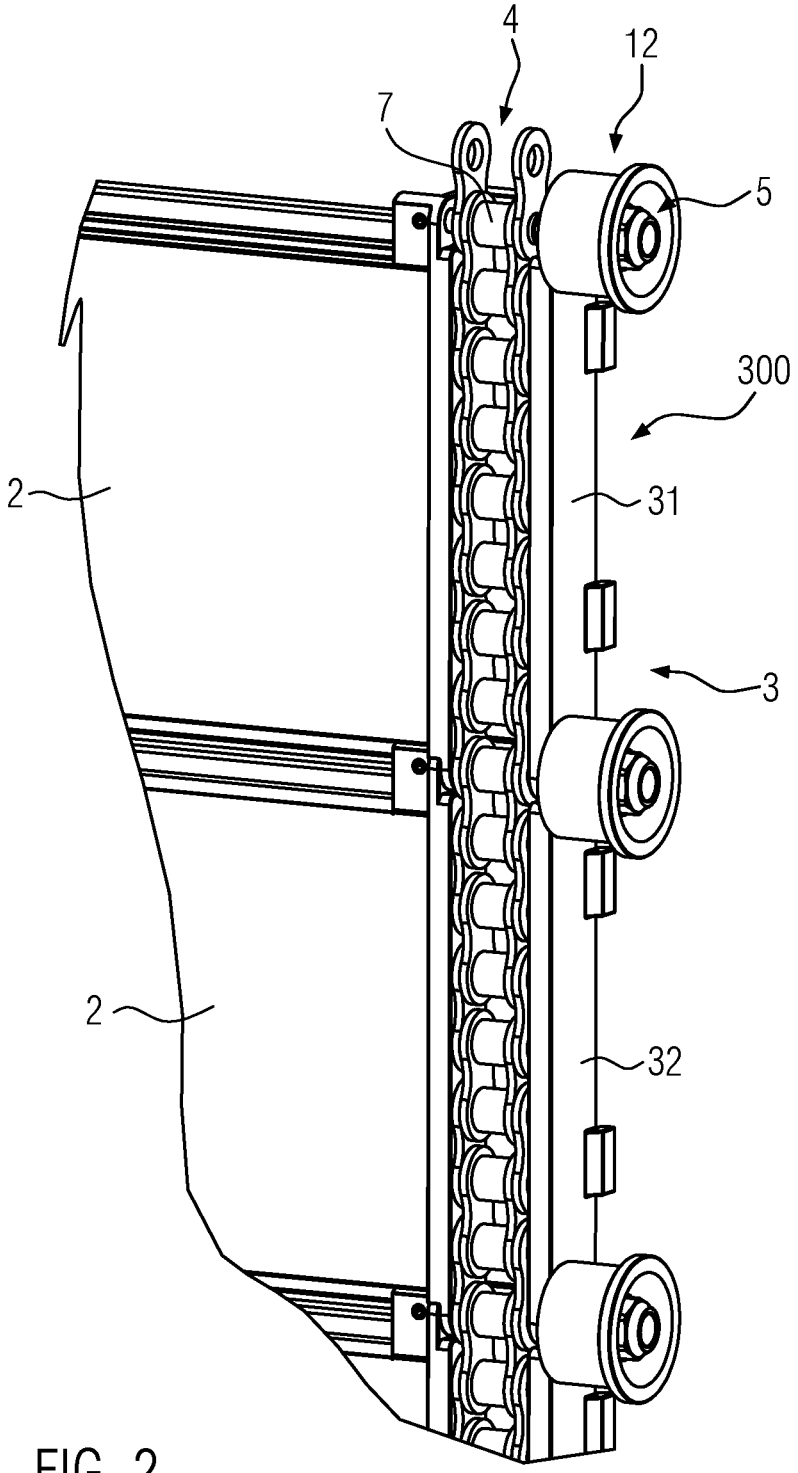
Figure 3:
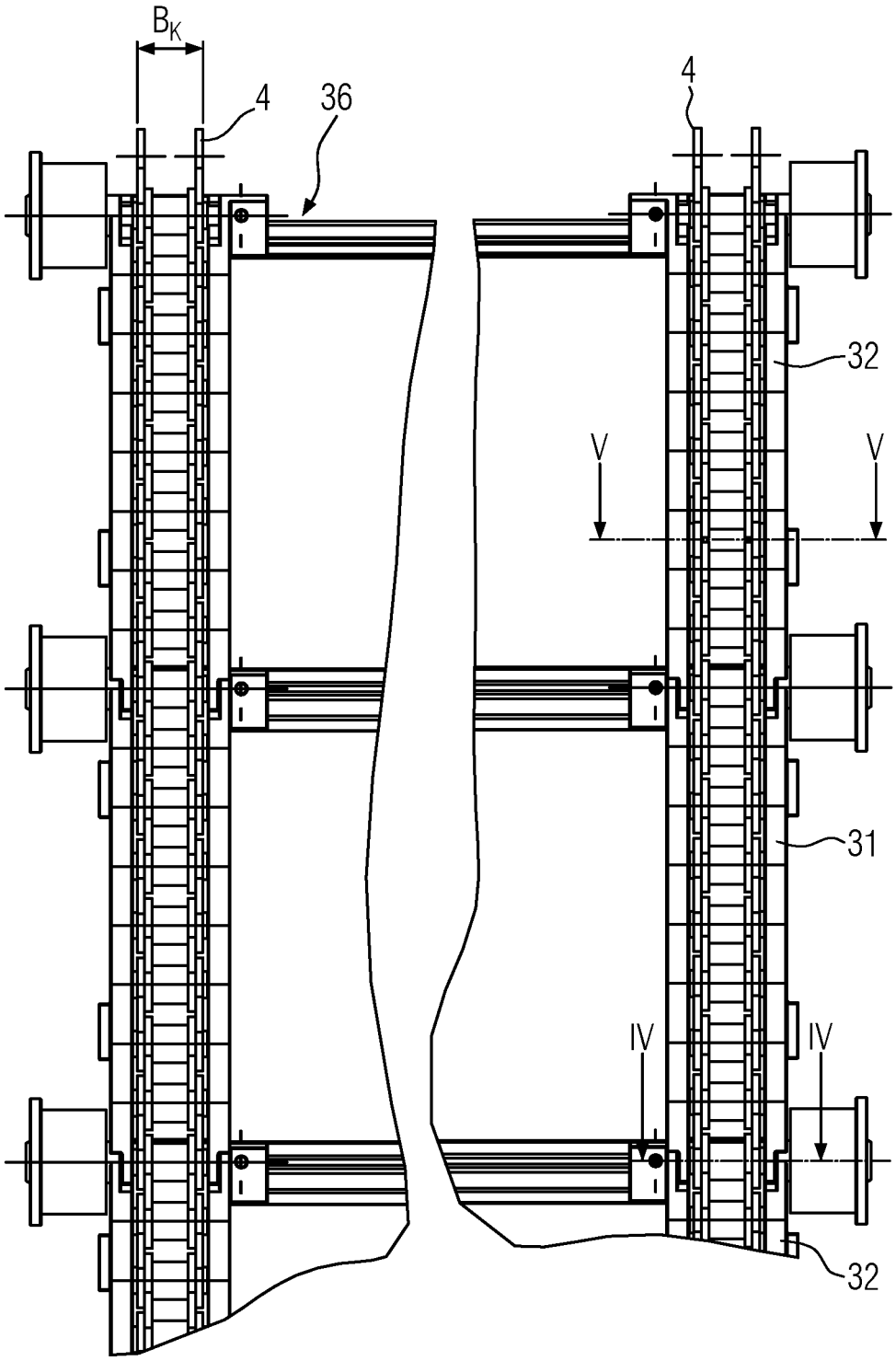
Figure 6:
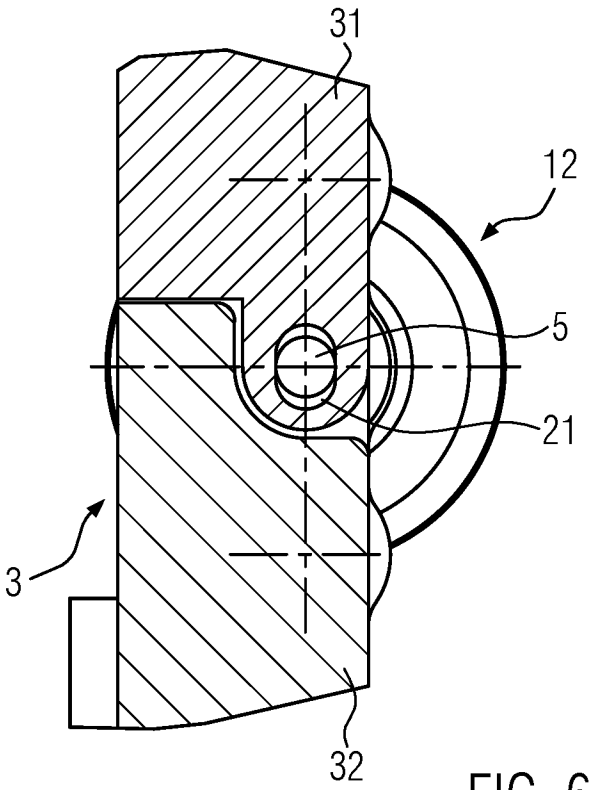
Figure 4:
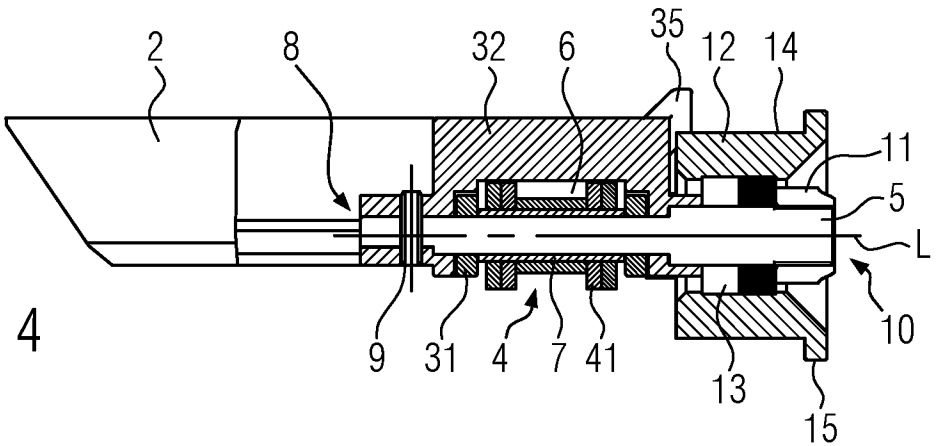
Figure 5:
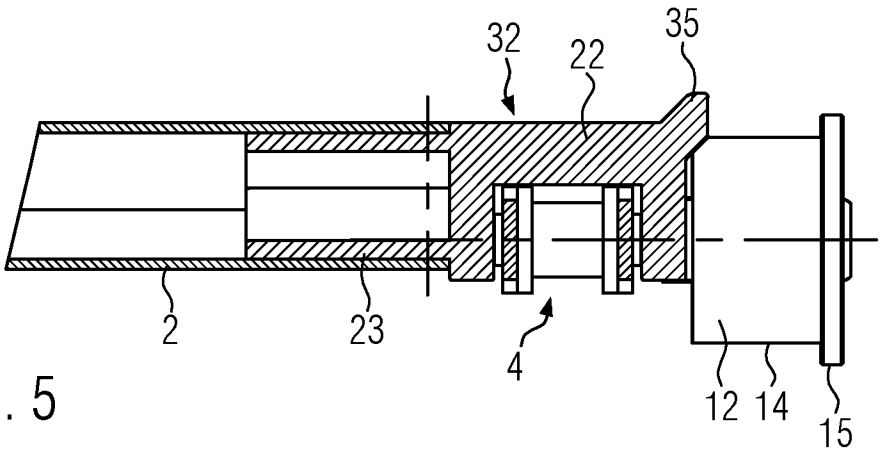
Figure 7:
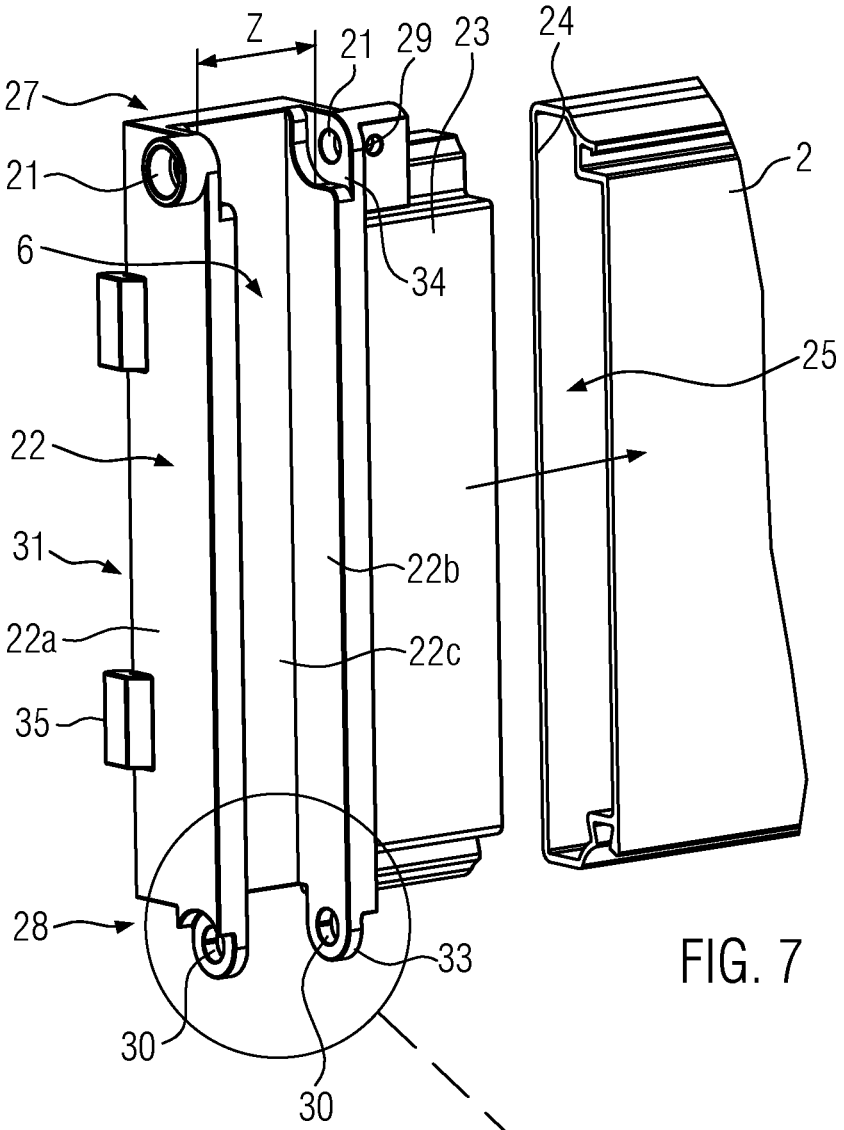
Figure 8:
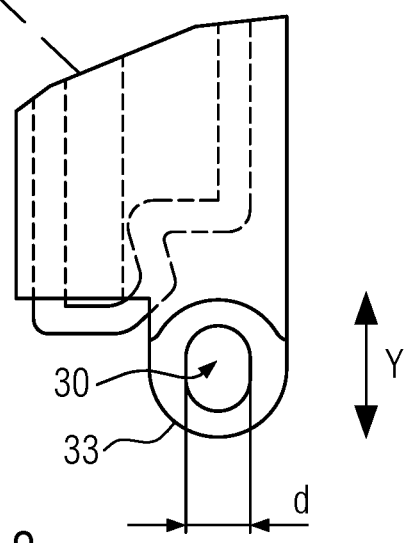
Figure 9:
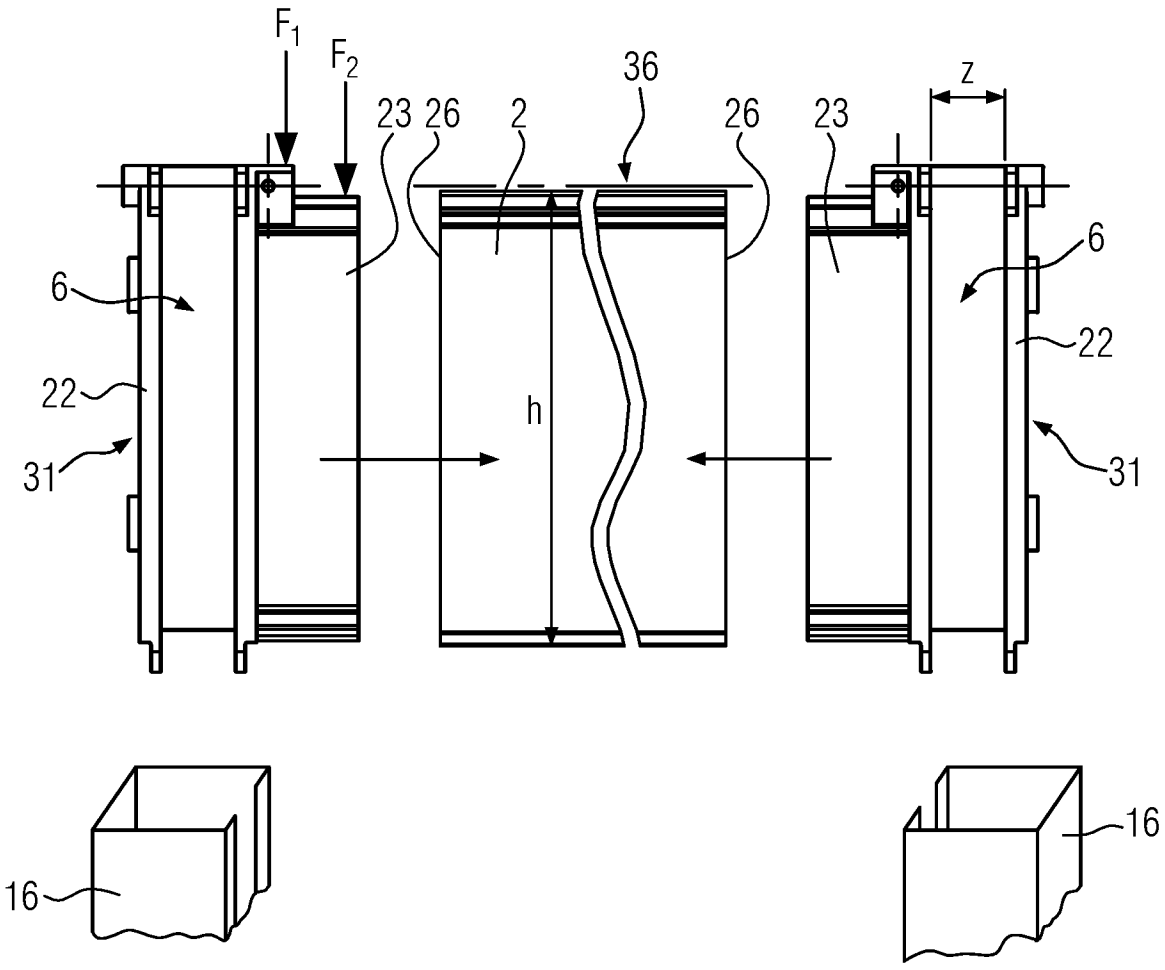
Figure 10:
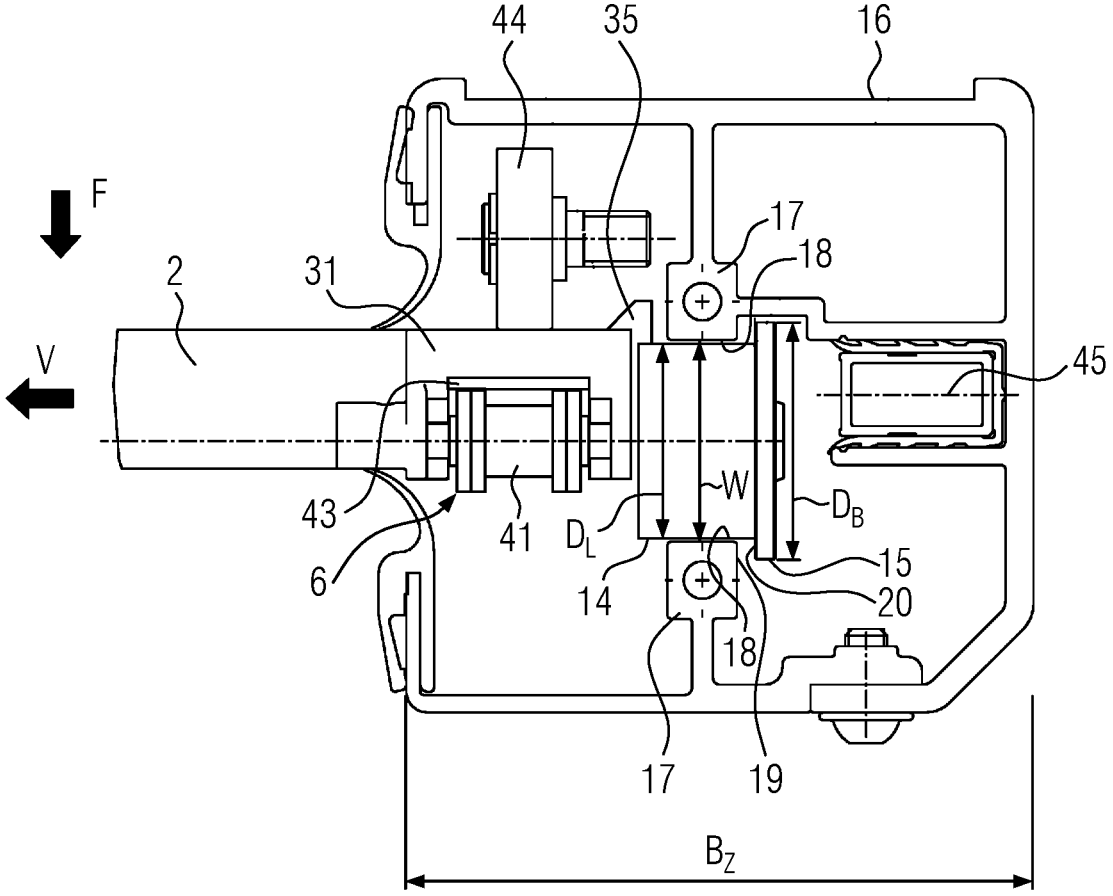
Figure 11:
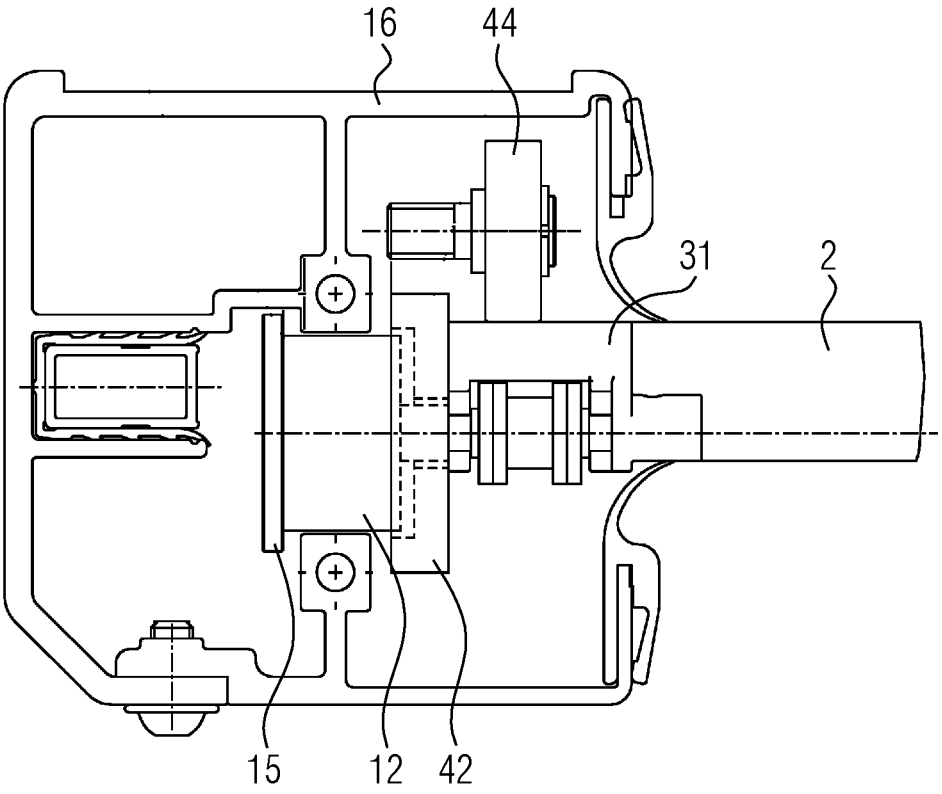
Figure 12:
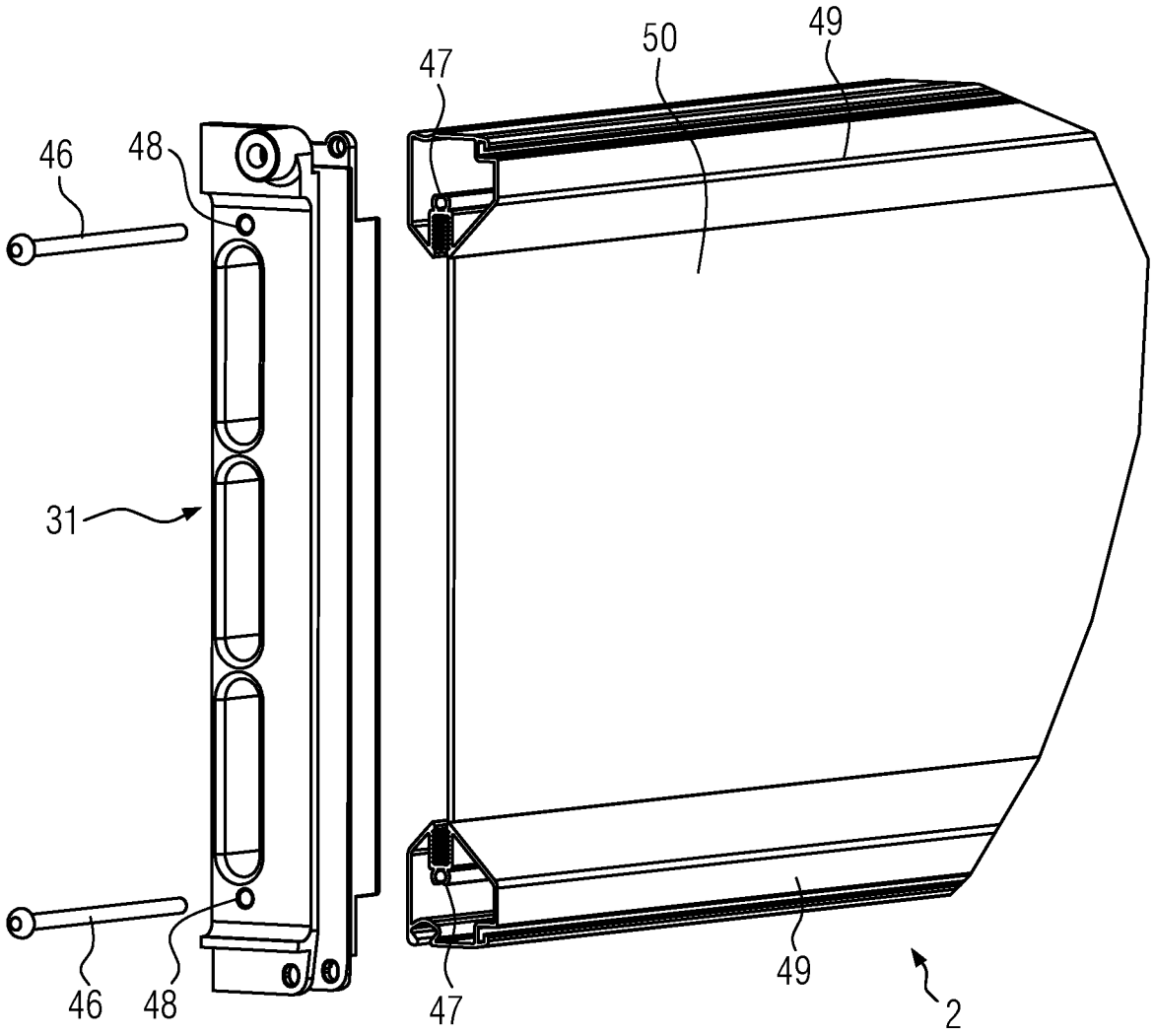
Figure 13:
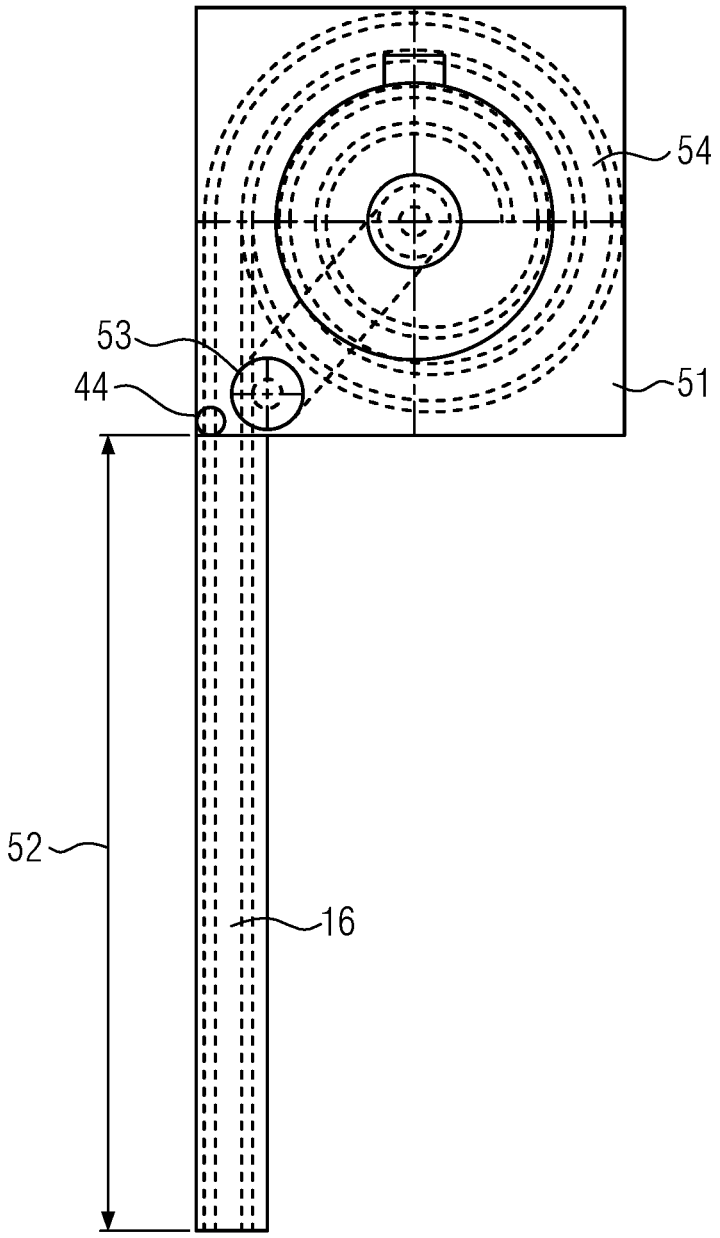

A possible embodiment of the invention is explained with reference to the drawing, where FIG. 1 shows a gate according to the invention in a front view, in which the undefined length of the gate panel segments is illustrated by dividing lines, FIG. 2 shows a detail of a gate according to the invention in a perspective view, FIG. 3 shows a detail of the gate according to the invention in a front view, in which the undefined length of the gate panel segments is illustrated by dividing lines, FIG. 4 shows a sectional view along the horizontal sectional line IV-IV in FIG. 3, FIG. 5 shows a sectional view along the horizontal sectional line V-V in FIG. 3, FIG. 6 shows a detail of a hinge of a gate according to the invention in a side view, FIG. 7 shows a perspective view of an individual hinge part ("Scharniergewerbe") together with a detail of a gate panel segment of a gate according to the invention, FIG. 8 shows a detailed view of a portion of the hinge part ("Scharniergewerbe") of FIG. 7, shown in a side view, FIG. 9 shows a schematic overview of a gate panel segment together with hinge parts ("Scharniergewerbe") in a front view, where the undefined length of the gate panel segment is illustrated by dividing lines, and FIG. 10 shows a gate frame profile in a cross-sectional view with a gate panel segment arranged therein, FIG. 11 shows a gate frame profile in a cross-sectional view with a gate panel segment arranged therein according to an alternative embodiment of the invention, FIG. 12 shows an exploded perspective view of a connection of a gate panel segment with a hinge part ("Scharniergewerbe") according to a further alternative embodiment of the invention, FIG. 13 shows a schematic side view of the gate in FIG. 1.

Identical reference characters are used for features that are repeated in different figures.

FIG. 1 shows a gate according to the invention with a gate panel 1, which comprises several gate panel segments 2. The gate is vertically movable, where the gate is opened in the direction of arrow A and closed in the direction of arrow B.

Two adjacent gate panel segments 2 are each hingedly connected to one another by way of at least one hinge 3. As shown in FIG. 2, a hinge 3 comprises two hinge parts ("Scharniergewerbe"), namely a first hinge part ("Scharniergewerbe") 31 and a second hinge part ("Scharniergewerbe") 32 connected thereto in an articulated manner. Hinge parts ("Scharniergewerbe") 31, 32 can be made from metal or plastic materials, such as, for example, fiber-reinforced polyamide.

The gate according to the invention is moved between an open position and a closed position by motor drive 100, presently not illustrated. The force required for lifting and lowering gate panel 1 is transmitted from motor drive 100 to gate panel 1 via at least one drive means, in the present embodiment via chain 4.

Connection means 5 connect chain 4 to gate panel 1. Several gate panel segments 2 are there each connected individually to chain 4. Connection means 5 are explained in more detail below with reference to FIG. 4. Only some gate panel segments 2 can be connected to drive means 4, but also all gate panel segments 2.

FIG. 2 shows chain 4 serving as the drive means. This embodiment of the invention is a hollow pin chain, i.e. the individual links of chain 4 are connected to each other by hollow pins 7 For example, a connection means 5 can extend through such a hollow pin 7.

As can be seen in FIG. 3, a chain 4 serving as a drive means can be located at the outward ends of gate panel 1. The gate can then be operated selectively with one or two drive means. Chain 4 is formed as a finite drive means. The lower end of chain 4 is located at the lowermost gate panel segment, the upper end of chain 4 is located on the uppermost gate panel segment.

FIG. 4 shows a cross-sectional view along the sectional line IV-IV depicted in FIG. 3. A hinge part ("Scharniergewerbe") 32 is shown, which is connected to a gate panel segment 2. Hinge part ("Scharniergewerbe") 32 comprises a recess 6 in which chain 4 is accommodated. Chain 4 is inserted into recess 6 of hinge part ("Scharniergewerbe") 32.

FIG. 4 shows a single chain link 41 with a hollow pin 7. A connection means, presently a hinge pin 5, in its axial direction extends through hinge part ("Scharniergewerbe") 32 and through hollow pin 7 of chain link 41. Hinge pin 5 is on one end 8, that faces gate panel segment 2, secured with a pin 9 against axially translational and radially rotational motions. Hinge pin 5 is fixed at the opposite end by a suitable device, presently a nut 11.

A guide roller 12 is rotatably mounted on hinge pin 5 by way of commercially available bearings 13. Guide roller 12 is arranged in the axial direction between nut 11 and hinge part ("Scharniergewerbe") 32. Guide roller 12 comprises a running surface 14 and an externally disposed shoulder 15. Externally disposed shoulder 15 is spaced apart in the radial direction further from the center axis L of hinge pin 5 than running surface 14. Shoulder 15 serves as a horizontal guide for gate panel segments 2 during a vertical motion of gate panel 1.

FIG. 10 shows the arrangement according to the invention which is at least in part disposed in a gate frame profile 16.

Gate frame profile 16 is shown in a cross-sectional view. It is a segmented hollow profile, in the interior of which at least two profile members 17 are located approximately symmetrically opposite to each other. The clear width W of the two profile members 17 is somewhat larger than the diameter $D_L$ at running surfaces 14 of guide roller 12.

Profile members 17 comprise oppositely disposed running surfaces 18 which can bear against running surfaces 14 of guide roller 12. Due to this arrangement of guide roller 12 between two oppositely disposed profile members 17, guide roller 12, including gate panel segment 2 fastened thereto, is guided in its vertical direction of motion during a vertical motion of gate panel 1.

Shoulder 15 of guide roller 12 has a diameter $D_B$ which is greater than the diameter $D_L$ at running surfaces 14 of guide roller 12. The diameter $D_B$ of shoulder 15 is also greater than the clear width W of the two profile members 17. This results in a contact surface 20 on the inner side of shoulder 15 which can bear against an oppositely disposed contact surface 19 of profile members 17.

If, for example, a force F acts upon a gate panel segment 2, then this leads to flexing of gate panel segment 2 and therefore to a translational motion of gate panel segment 2 in the direction of motion arrow V. In such a case, shoulder 15 of guide roller 12 prevents guide roller 12 as well as gate panel segment 2 arranged thereon from slipping out from profile members 17 of gate frame profile 16. Gate panel segment 2 is thus guided approximately horizontally during a vertical motion of the gate.

A light barrier 45 is disposed on a side opposite to the opening of gate frame profile 16, by use of which it is possible to monitor whether the gate is in the open or closed state or whether an obstacle is blocking the path of open gate panel 2.

Disposed on the side of hinge part ("Scharniergewerbe") 31 opposite to drive means 4 is a retaining roller 44 which is rotatably mounted on gate frame profile 16 and assumes the function of a guide. When gate panel 2 is opened and closed, retaining roller 44 rolls over the surface of hinge part ("Scharniergewerbe") 31 which is disposed opposite to drive means 4 and with which retaining roller 44 is in contact.

Retaining roller 44 is located in the upper region of the closed gate panel in the region of the gate lintel in order to improve engagement of the sprocket with the drive means. It is also possible to provide several retaining rollers 44 on gate frame profile 16, for example, in the lower region of the closed gate or distributed over the height of the gate.

Provided in recess 6, in which chain links 41 of drive means 4 are received, between drive means 4 and a rear surface in recess 6, is a damper 43 with which both recess 6 as well as drive means 4 are in contact. Damper 43 can be fabricated from soft and/or elastic material, for example, from an elastomer.

FIG. 6 shows a hinge 3. Hinge 3 comprises a first hinge part ("Scharniergewerbe") 31 and a second hinge part ("Scharniergewerbe") 32. Both hinge parts ("Scharniergewerbe") 31, 32 each comprise an aligned bore 21 through which connection means 5 extends. Connection means 5 serves as a hinge pin 5 and forms an articulation axis about which hinge 3 can be pivoted in a known manner.

FIG. 7 shows a single hinge part ("Scharniergewerbe") 31 by way of example. Hinge part ("Scharniergewerbe") 31 comprises a guide section 22 on an outer lateral end side. Guide section 22 is composed of two vertical walls 22*a*, 22*b* and a horizontal wall 22*c* disposed therebetween which connects the two vertical walls 22*a*, 22*b*. The resulting U-shape forms a recess 6.

The clear width Z of recess 6 is slightly larger than the width $B_K$ of chain 4 (see FIG. 3). Chain 4 can be accommodated in recess 6 and can be inserted into recess 6.

Hinge part ("Scharniergewerbe") 31 comprises a connection portion 23 which is located on vertical wall 22*b* facing gate panel segment 2 and which is preferably formed integrally with guide section 22. Connection portion 23 has an outer shape which corresponds approximately to the inner hollow profile shape 24 of gate panel segment 2. A gate panel segment 2 can thus be pushed onto connection portion 23 in a fitting manner.

Hinge part ("Scharniergewerbe") 31 is arranged in a cavity 25 of gate panel segment 2. In order to provide a reliable connection between hinge part ("Scharniergewerbe") 31 and gate panel segment 2, hinge part ("Scharniergewerbe") 31 is preferably glued to gate panel segment 2 in the region of connection portion 23 However, other forms of connection, such as, for example, screw connections, are not excluded.

As can be seen in FIG. 9, hinge parts ("Scharniergewerbe") 31, 32 can be mounted on both sides on a gate panel segment 2 in the manner described with reference to FIG. 7. Furthermore, FIG. 9 shows that the respective hinge part ("Scharniergewerbe") 31, 32 is arranged on a face side end side 26 of gate panel segment 2 facing gate frame 16 and extends approximately over the entire height h of gate panel segment 2.

The individual hinge parts ("Scharniergewerbe") 31, 32 of a hinge 3 have the same external shape and are, in particular, approximately identical parts, preferably injection-molded parts. FIGS. 7 and 8 show that a hinge part ("Scharniergewerbe") 31, 32 comprises a bore 21 at its one axial end 27 for receiving a hinge pin 5.

FIG. 4 shows an arrangement of this kind in a cross-sectional view, where a hinge pin 5 is guided through precisely these bores 21 of hinge part ("Scharniergewerbe") 31.

The inner diameter of bore 21 is slightly larger than the outer diameter of hinge pin 5. The arrangement of hinge pin 5 in bore 21 realizes a fixed bearing with a rotational degree of freedom, i.e. hinge part ("Scharniergewerbe") 31, 32 can rotate about hinge pin 5 with bore 21 provided at its one axial end.

In order to secure hinge pin 5 against twisting or displacement, a previously described pin 9 is inserted through a bore provided in hinge pin 5, which bore extends transversely to the longitudinal axis L of hinge pin 5. Pin 9 is further inserted through a transverse bore 29 (FIG. 7), which is produced in hinge part ("Scharniergewerbe") 31 and preferably provided in connection portion 23.

FIGS. 6, 7 and 8 show that a hinge part ("Scharniergewerbe") 31, 32 has a long hole 30 on its other axial side 28. Long hole 30 is a bore which is extended approximately in the direction of longitudinal extension Y (FIG. 8). The inner diameter d of long hole 30 is slightly larger than the outer diameter of hinge pin 5. A floating bearing is thus realized, where, due to long hole 30, hinge part ("Scharniergewerbe") 31, 32 is rotated both rotationally as well as translationally in the Y direction, i.e. along the direction of extension of long hole 30, about hinge pin 5.

As can best be seen in FIGS. 2, 3 and 6, the individual hinge parts ("Scharniergewerbe") 31, 32 can be connected to one another so that they form a hinge chain 300. Ends 27, 28 of a hinge part ("Scharniergewerbe") 31, 32 are there shaped in such a way that they can be fitted with bores 21, 30 one over the other.

Recesses 34 are provided on the inner sides of bores 21 (FIG. 7) of a hinge part ("Scharniergewerbe") 31, 32, into which fork ends 33 of an adjacent hinge part ("Scharniergewerbe") 31, 32 can be fitted. Since hinge parts ("Scharniergewerbe") 31, 32 all have the same shape, the individual hinge parts ("Scharniergewerbe") 31, 32 can be assembled to an arbitrarily long hinge chain 300.

Each hinge part ("Scharniergewerbe") 31, 32 comprises a lateral guide element 35 which is suitable to support and guide gate panel segment 2, which is connected to this hinge part ("Scharniergewerbe") 31, 32, in a direction opposite to the horizontal direction V (FIG. 10) against profile member 17 during a vertical motion of gate panel 1. Lateral guide element 35 is arranged on the lateral outer side of first vertical wall 22*a* of guide section 22 of a hinge part ("Scharniergewerbe") 31, 32.

FIG. 11 shows an alternative embodiment of gate panel 1 which comprises a sliding disk 42. The type and perspective of the representation corresponds to the one already selected in FIG. 10, but for a horizontally oppositely disposed side of the gate panel.

In this embodiment, gate panel 2 has no lateral guide element 35 and no damper 43. For lateral guidance of gate panel 2, a sliding element 42 is provided between hinge part ("Scharniergewerbe") 31 which is thus disposed opposite to shoulder 15 in the axial direction relative to guide roller 12. In the event of horizontal displacement of gate panel 2, sliding element 42 can contact one or both of the gate frame profiles 16 and slide along them in order to limit the horizontal movability of gate panel 2. In the embodiment shown, sliding element 42 is approximately round and provided with a center hole, where connection means 5 extends through this hole, thereby fastening sliding element 42.

Sliding element 42 can be fabricated from low-friction and/or comparatively soft material in order to minimize frictional forces between sliding element 42 and gate frame profile 16 as well as the wear of the guide roller and gate frame profile 16. In particular, if a sliding element 42 is provided on each of the two horizontally mutually oppositely disposed connection means 5 of a gate panel segment 2, horizontal guidance of guide rollers 12 can be effected substantially by sliding element 42.

Gate panel 2 can have several sliding elements 42 distributed over its height. For example, sliding elements 42 can always be arranged in pairs that are disposed horizontally opposite to each other. Such pairs of sliding elements 42 can be evenly distributed over the height of the closed gate panel, for example, with a total of three pairs at the upper end, at the lower end, and approximately at the center.

FIG. 12 shows an alternative embodiment of the connection between a gate panel segment 2 and a hinge part ("Scharniergewerbe") 31 in an exploded view. In this embodiment, the gate panel segment is composed of two profile elements 49 and a cover 50 received between profile elements 49. Profile elements 49 can be made of metal, preferably aluminum. Numerous materials are also possible for the cover, for example, metals or plastic materials, preferably transparent plastic materials.

Profile elements 49 each comprise a screw hole 47 with an internal thread. In this embodiment, the hinge part ("Scharniergewerbe") comprises two through bores 48, the spacing of which corresponds to the spacing of screw holes 47 of gate panel segment 2. The connection between hinge part ("Scharniergewerbe") 31 and gate panel segment 2 can be established by screwing screws 46 through bores 48 of hinge part ("Scharniergewerbe") 31 and to screw holes 47 of profile elements 49.

FIG. 13 shows the position of gate lintel 51 and passage height 52 of the gate depending thereon. Gate panel 2 can be rolled up in gate lintel 51 in the shape of a spiral 54 when it is opened. In this variant of the invention, the drive element is designed in the shape of a motor-driven sprocket 53. Sprocket 53 is also located within gate lintel 51 and therefore above passage height 52. Sprocket 53 is in engagement with chain 4 and can open and close the gate with its rotation.

Provided in the vicinity of sprocket 53 and approximately opposite thereto is retaining roller 44, so that hinge parts ("Scharniergewerbe") 31, 32 with drive means 4 pass through between sprocket 53 and the retaining roller when the gate is opened and closed.

The arrangement described with reference to the figures acts as follows:

Chain 4 is by way of engagement connected to sprocket 53 and serves to drive the entire gate panel 1. The drive of sprocket 53 is effected by way of a motor (not shown). Gate panel 1 consists of several gate panel segments 2, where several of these gate panel segments 2, and preferably all gate panel segments 2, are connected to chain 4. Preferably, each gate panel segment 2 is fastened individually with a respective hinge pin 5 to chain 4.

The static weight forces as well as the dynamic forces occurring during operation are thus transmitted approximately uniformly at the respective connecting points formed by chain 4 and hinge pin 5 to the respective gate panel segment 2 connected thereto. The total force therefore no longer needs to be absorbed by the lowermost gate panel segment, but is distributed as uniformly as possible over the entire gate panel 1.

The forces $F_1$, $F_2$ (FIG. 9) required for lifting the individual gate panel segment 2 arise at the contact points of connection portion 23 with gate panel segment 2 and are transmitted mainly by chain 4. Hinge parts ("Scharniergewerbe") 31, 32 serve merely to connect individual gate panel segments 2 to one another in an articulated manner. Due to the special suspension of the individual hinge parts ("Scharniergewerbe") 31, 32 on hinge pin 5, only small forces arise at hinge parts ("Scharniergewerbe") 31, 32 themselves, in particular, in the region of their bores 21, 30, which are small to negligible as compared to the forces $F_1$, $F_2$ required for lifting gate panel 1.

The common connection between chain 4, hinge pin 5 and the individual hinge parts ("Scharniergewerbe") 31, 32 also causes chain 4 and the individual hinge parts ("Scharniergewerbe") 31, 32 to move substantially together. Long holes 30 serve, in particular, to exclude a static overdetermination of the system and thereby to compensate for tolerances or changes in length between chain 4 and hinge parts ("Scharniergewerbe") 31, 32.

It is there advantageous if hinge pins 5 are arranged in the upper half of a gate panel segment 2, and, in particular, in the region of an upper edge 36 of gate panel segment 2, as shown in FIGS. 3, 4 and 9. The individual gate panel segments 2 are then hanging vertically downwardly, following gravity.

A change in load in chain 4 and gate panel segments 2 arises only above the sprocket, i.e. in the region of gate lintel 51, in which gate panel 2 is supported in the open state, i.e. is rolled up, where tensile and compressive forces arising between the gate panel segments when rolling up the gate panel are lower than those when lifting the gate panel 2 in the passage area.

Recess 6 formed in hinge parts ("Scharniergewerbe") 31, 32 serves as stable lateral guidance of chain 4 as well as protection of chain 4 against external influences. The arrangement of chain 4 in recess 6 also leads to a compact design which is further promoted by the fact that chain 4, inserted into hinge parts ("Scharniergewerbe") 31, 32, is arranged between gate panel segments 2 and a guide roller 12, where hinge pin 5 can simultaneously be used as the axis for this guide roller 12.

Damper 43 provided between chain 4 and recess 6 reduces the noise arising during the movement of gate panel 1, which can occur due to slight movements of chain 4 and hinge parts ("Scharniergewerbe") 31, 32. Another source of noise that damper 43 counteracts is the engagement of sprocket 53 with chain 4.

This compact design leads to the fact that the frame width $B_Z$ can be reduced as compared to prior art. Due to the frame width being reduced, the passage width of the gate can be increased.

The invention claimed is:

1. A vertically movable gate with a gate panel comprising several gate panel segments, where two adjacent gate panel segments of said several gate panel segments are each hingedly connected to one another by way of at least one hinge, at least one elongated drive means, a motorized drive which transmits a force for lifting and lowering said gate panel via the at least one elongated drive means to said gate panel, and connection means for connecting said at least one elongated drive means to said gate panel, where from the several gate panel segments at least several gate panel segments are each individually connected to said at least one elongated drive means, and a sliding element arranged between at least one surface of a gate frame profile and at least one hinge part of said at least one hinge, where said sliding element is configured to slide during vertical movement of the gate and said sliding element is supported on said connection means.

2. The gate according to claim 1, characterized in that each gate panel segment from said several gate panel segments is connected to said at least one elongated drive means.

3. The gate according to claim 1, characterized in that said at least one elongated drive means is a finite drive means.

4. The gate according to claim 1, characterized in that said connection means extends through a part of said at least one elongated drive means.

5. The gate according to claim 1, characterized in that a damper is arranged between said at least one elongated drive means and at least one surface of said at least one hinge part and is configured for damping relative motion between said at least one elongated drive means and said at least one hinge part.

6. The gate according to claim 1, characterized in that said connection means comprises a guide roller having a shoulder for horizontally guiding said several gate panel segments during a vertical motion of said gate panel, where said connection means is an axle that bears said guide roller.

7. The gate according to claim 1, characterized in that said connection means comprises a guide roller having a shoulder for horizontally guiding said several gate panel segments during a vertical motion of said gate panel, and in that said connection means is an axle that bears said guide roller, and said sliding element is provided between a hinge part of the at least one hinge part and said guide roller.

8. The gate according to claim 1, characterized in that said connection means comprises a guide roller having a shoulder for horizontally guiding said several gate panel segments during a vertical motion of said gate panel, and in that said connection means is an axle that bears said guide roller, said at least one elongated drive means and said at least one hinge are arranged between said guide roller and a gate panel segment.

9. The gate according to claim 1, characterized in that a hinge part of said at least one hinge part is connected to a gate panel segment of the several gate panel segments by way of a screw connection, where said gate panel segment includes at least one bore with a thread and said at least one hinge part comprises at least one through bore through which a screw extends.

10. The gate according to claim 1, characterized in that said connection means connecting said at least one elongated drive means to said gate panel is connected to a gate panel segment of the several gate panel segments in the upper half of said gate panel segment, and in a region of an upper edge of said gate panel segment.

11. The gate according to claim 1, characterized in that a drive element is a sprocket which engages with said at least one elongated drive means and is provided above a passage height of said gate in a gate lintel.

12. The gate claim according to claim 1, characterized in that said at least one elongated drive means is different from said at least one hinge.

13. The gate according to claim 1, characterized in that said connection means is arranged in a joint region of a hinge of said at least one hinge, and is a hinge pin connecting one hinge part and a second hinge part to form two hinge parts of a hinge of said at least one hinge.

14. The gate according to claim 13, characterized in that said two hinge parts are formed in combination with said at least one elongated drive means.

15. The gate according to claim 13, characterized in that said at least one elongated drive means is arranged integrated in said two hinge parts of the hinge.

16. The gate according to claim 13, characterized in that each hinge part of said two hinge parts comprises a recess for receiving said at least one elongated drive means, where each recess is arranged in alignment with the other recess.

17. The gate according to claim 1, characterized in that a hinge part of said at least one hinge has at its one end a fixed bearing and at its opposite end a floating bearing, wherein the floating is defined by an elongated hole.

18. The gate according to claim 17, characterized in that said at least one hinge comprises a plurality of hinges, where said hinge part of different hinges of said plurality of hinges is connected to one another and form a hinge chain.

19. The gate according to claim 1, characterized in that the sliding element is a sliding disk, the sliding disk arranged between at least one surface of a gate frame profile and at least one hinge part, where said sliding disk is configured to slide during vertical movement of the gate and said sliding disk is supported on said connection means.

20. The gate according to claim 19, where said sliding disk is configured to slide along the gate frame profile to limit horizontal movement of the gate panel.

21. The gate according to claim 1, characterized in that said at least one hinge part comprises at least one lateral guide element which is adapted to guide a gate panel segment of said several gate panel segments in an approximately horizontal direction during vertical motion of said gate panel, where said at least one hinge part is connected to said guide panel segment to be guided by said at least one lateral guide element.

22. The gate according to claim 21, characterized in that said at least one hinge part is arranged on an end side on a face side of said panel segments facing the gate frame profile and extends approximately over the entire height of said respective gate panel segment.

23. The gate according to claim 21, characterized in that said at least one hinge part is arranged at least in part in a cavity of said gate panel segment of said several gate panel segments and is connected substantially within said cavity to said gate panel segment, where said at least one hinge part and said gate panel segment are connected to one another by adhesive bonding.

24. A vertically movable gate with a gate panel comprising several gate panel segments, where two adjacent gate panel segments of said several gate panel segments are each hingedly connected to one another by way of at least one hinge, and at least one elongated drive means, a motorized drive which transmits a force for lifting and lowering said gate panel via the at least one elongate drive means to said gate panel, and connection means for connecting said drive means to said gate panel, where from the several gate panel segments at least several panels are each individually connected to said drive means, where the at least one hinge, the at least one elongated drive means, and the connection means are arranged at least partially within a gate frame.

* * * * *